US010229625B2

(12) United States Patent
Abe et al.

(10) Patent No.: US 10,229,625 B2
(45) Date of Patent: Mar. 12, 2019

(54) LIQUID CRYSTAL DRIVE APPARATUS, IMAGE DISPLAY APPARATUS AND STORAGE MEDIUM STORING LIQUID CRYSTAL DRIVE PROGRAM

(71) Applicant: CANON KABUSHIKI KAISHA, Tokyo (JP)

(72) Inventors: Masayuki Abe, Tokyo (JP); Masao Ono, Utsunomiya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 141 days.

(21) Appl. No.: 15/254,355

(22) Filed: Sep. 1, 2016

(65) Prior Publication Data

US 2017/0069247 A1 Mar. 9, 2017

(30) Foreign Application Priority Data

Sep. 8, 2015 (JP) ..... 2015-176811

(51) Int. Cl.
*G09G 3/20* (2006.01)
*G09G 3/36* (2006.01)

(52) U.S. Cl.
CPC ..... *G09G 3/2029* (2013.01); *G09G 3/2003* (2013.01); *G09G 3/3611* (2013.01)

(58) Field of Classification Search
CPC .. G09G 3/2029; G09G 3/3611; G09G 3/2003; G09G 3/2007; G09G 3/2085
See application file for complete search history.

(56) References Cited

U.S. PATENT DOCUMENTS 6,476,875 B2 11/2002 Correa et al.
7,535,448 B2 5/2009 Hiroki
(Continued)

FOREIGN PATENT DOCUMENTS

JP 2589567 B2 3/1997
JP 10096896 A 4/1998
(Continued)

OTHER PUBLICATIONS

Office Action issued in Japanese Application No. 2015-176811 dated Aug. 23, 2016.
(Continued)

*Primary Examiner* — Michael A Faragalla
*Assistant Examiner* — Sujit Shah
(74) *Attorney, Agent, or Firm* — Rossi, Kimms & McDowell LLP

(57) ABSTRACT

The liquid crystal drive apparatus controls application of a first or second voltage to each pixel of a liquid crystal element in respective sub-frame periods in one frame period to cause that pixel to form a tone. The sub-frame period where the first voltage is applied to the pixel is referred to as an ON period, the sub-frame period where the second voltage is applied to the pixel is referred to as an OFF period. The sub-frame period corresponding to the ON and OFF periods respectively for first and second pixels of two mutually adjacent pixels is referred to as an ON/OFF adjacent period. The apparatus provides, when causing the first and second pixels to form tones adjacent to each other, a plurality of the ON/OFF adjacent periods each being 1.0 ms or less separately from each other in the one frame period.

7 Claims, 9 Drawing Sheets

(56) References Cited

U.S. PATENT DOCUMENTS

| | | | | |
|---|---|---|---|---|
| 7,982,755 | B2 | 7/2011 | Ochi et al. | |
| 8,063,897 | B2 | 11/2011 | Mamba et al. | |
| 8,223,091 | B2 | 7/2012 | Ishihara et al. | |
| 8,471,874 | B2 | 6/2013 | Sato et al. | |
| 8,823,617 | B2 | 9/2014 | Kurosawa | |
| 8,963,967 | B2 | 2/2015 | Yoshinaga | |
| 9,013,523 | B2 | 4/2015 | Kajiyama et al. | |
| 9,058,767 | B2 | 6/2015 | Toyooka | |
| 9,241,092 | B2 | 1/2016 | Kitagawa et al. | |
| 2002/0097207 | A1 | 7/2002 | Pfeiffer et al. | |
| 2003/0214463 | A1 | 11/2003 | Lim et al. | |
| 2005/0073616 | A1 | 4/2005 | Joo et al. | |
| 2005/0162360 | A1 | 7/2005 | Ishihara et al. | |
| 2006/0038501 | A1 | 2/2006 | Koyama et al. | |
| 2007/0018945 | A1 | 1/2007 | Machida et al. | |
| 2008/0062162 | A1 | 3/2008 | Mamba et al. | |
| 2008/0088554 | A1 | 4/2008 | Lee | |
| 2008/0284700 | A1 | 11/2008 | Oke et al. | |
| 2009/0058890 | A1 | 3/2009 | Kurihara | |
| 2011/0164072 | A1 | 7/2011 | Kosuge | |
| 2011/0248979 | A1* | 10/2011 | Nishimura | G09G 3/2033 345/211 |
| 2011/0249050 | A1 | 10/2011 | Ozawa et al. | |
| 2012/0154555 | A1 | 6/2012 | Iwanaka et al. | |
| 2012/0262501 | A1* | 10/2012 | Toyooka | G09G 3/2022 345/690 |
| 2013/0050286 | A1 | 2/2013 | Yoshinaga et al. | |
| 2013/0050304 | A1* | 2/2013 | Yoshinaga | G09G 3/36 345/694 |
| 2013/0050305 | A1 | 2/2013 | Yoshinaga | |
| 2013/0135272 | A1 | 5/2013 | Park | |
| 2014/0062981 | A1 | 3/2014 | Huang et al. | |
| 2017/0124959 | A1 | 5/2017 | Kim et al. | |

FOREIGN PATENT DOCUMENTS

| | | | |
|---|---|---|---|
| JP | 2000163019 | A | 6/2000 |
| JP | 2002236472 | A | 8/2002 |
| JP | 2004309843 | A | 11/2004 |
| JP | 2005173573 | A | 6/2005 |
| JP | 2006171651 | A | 6/2006 |
| JP | 2006201630 | A | 8/2006 |
| JP | 2007316381 | A | 12/2007 |
| JP | 2008009391 | A | 1/2008 |
| JP | 2008033276 | A | 2/2008 |
| JP | 2008065167 | A | 3/2008 |
| JP | 2008176286 | A | 7/2008 |
| JP | 2008268286 | A | 11/2008 |
| JP | 2009020335 | A | 1/2009 |
| JP | 2009162937 | A | 7/2009 |
| JP | 2009294266 | A | 12/2009 |
| JP | 2010250043 | A | 11/2010 |
| JP | 2011221215 | A | 11/2011 |
| JP | 2012103356 | A | 5/2012 |
| JP | 2012128197 | A | 7/2012 |
| JP | 2012203052 | A | 10/2012 |
| JP | 2012226041 | A | 11/2012 |
| JP | 2012242435 | A | 12/2012 |
| JP | 2013050679 | A | 3/2013 |
| JP | 2013050681 | A | 3/2013 |
| JP | 2013050682 | A | 3/2013 |
| JP | 2013195488 | A | 9/2013 |

OTHER PUBLICATIONS

Office Action issued in U.S. Appl. No. 15/257,028 dated Oct. 16, 2017.
Office Action issued in U.S. Appl. No. 15/253,976 dated Apr. 4, 2018.
Office Action issued in Japanese Appln. No. 2015-176773, dated Sep. 6, 2016.
Office Action issued in Japanese Appln. No. 2015-176886, dated Sep. 6, 2016.
Office Action issued in Japanese Appln. No. 2015-177008, dated Sep. 13, 2016.
Office Action issued in Japanese Appln. No. 2015-176811 dated Jan. 5, 2017.
Office Action issued in Japanese Appln. No. 2015-177008 dated Jan. 31, 2017.
Refusal issued in Japanese Appln. No. 2015-176773 mailed Jan. 31, 2017.
Refusal issued in Japanese Appln. No. 2015-176886 dated Jan. 31, 2017.
Extended European Search Report issued in European Appln No. 16001835.4 dated Feb. 2, 2017.
Office Action issued in U.S. Appl. No. 15/257,028 dated May 14, 2018.
Notice of Allowance issued in U.S. Appl. No. 15/254,401 dated Sep. 21, 2018.
Notice of Allowance issued in U.S. Appl. No. 15/253,976 dated Aug. 28, 2018.
Office Action issued in U.S. Appl. No. 15/257,028 dated Sep. 6, 2018.
Notice of Allowance issued in U.S. Appl. No. 15/257,028 dated Jan. 9, 2019.

* cited by examiner

LIQUID CRYSTAL DRIVE APPARATUS, IMAGE DISPLAY APPARATUS AND STORAGE MEDIUM STORING LIQUID CRYSTAL DRIVE PROGRAM

BACKGROUND OF THE INVENTION

Field of the Invention

The present invention relates to a liquid crystal drive apparatus configured to drive a liquid crystal element by a digital driving method.

Description of the Related Art

Liquid crystal elements include transmissive liquid crystal elements such as a TN (Twisted Nematic) element and reflective liquid crystal elements such as a VAN (Vertical Alignment Nematic) element. These liquid crystal elements are driven by an analog drive method and a digital drive method. The analog drive method changes a voltage applied to a liquid crystal layer depending on tones to control lightness (brightness), and the digital drive method binarizes the voltage applied to the liquid crystal layer and changes a voltage application time period to control lightness. As such a digital drive method, a sub-frame drive method temporally divides one frame period into multiple sub-frame periods and controls application (ON) and non-application (OFF) of a predetermined voltage to each pixel to cause the pixel to display its tone.

Description will be made of a typical sub-frame drive method. FIG. 12 illustrates an example of dividing one frame period into multiple sub-frame periods (bit lengths). Numerical values written in the respective sub-frames indicate temporal weights of these sub-frames in the one frame period. The example shows a case of expressing 64 tones. In this example, a sub-frame period having a temporal weight of 1+2+4+8+16 is referred to as "an A sub-frame period", and a sub-frame period having a temporal weight of 32 is referred to as "a B sub-frame period". Furthermore, a sub-frame period where the predetermined voltage is applied is referred to as an ON period", and a sub-frame period where the predetermined voltage is not applied is referred to as an OFF period".

FIG. 13 illustrates all tone data corresponding to the division example illustrated in FIG. 17. A vertical axis indicates tones, and a horizontal axis indicates one frame period. A white sub-frame period indicates the ON period where the pixel is in a white display state, and a black sub-frame period indicates the OFF period where the pixel is in a black display state. According to these tone data, when two pixels adjacent to each other (hereinafter referred to as "adjacent pixels") in a liquid crystal element display two tones adjacent to each other (hereinafter referred to as "adjacent tones") such as 32 and 33 tones, the 32 tone is displayed by setting the A sub-frame period to the ON period and setting the B sub-frame period to the OFF period, and the 33 tone is displayed by setting the A sub-frame period to the OFF period and setting the B sub-frame period to the ON period.

Such a state where the ON and OFF periods temporally overlap each other in the adjacent pixels, that is, the predetermined voltage is applied to one (ON-period pixel) of the adjacent pixels and the predetermined voltage is not applied to the other one (OFF-period pixel) of the adjacent pixels generates so-called disclination, which generates a decrease in lightness of the ON-period pixel. FIG. 14 illustrates an example of the decrease in lightness due to the disclination. FIG. 19 illustrates tones in its vertical direction, and its contrasting density illustrates displayed lightness. When the disclination is not generated, a smooth contrasting density can be expressed. However, when the adjacent pixels display two adjacent tones (such as the 32 and 33 tones) corresponding to a case where the ON and OFF periods overlap each other for a long time, the displayed lightness is decreased due to the disclination, which generates a dark line.

Japanese Patent Laid-Open No. 2013-050681 discloses a drive circuit that divides one or more long sub-frame periods into periods each equal to a short sub-frame period to produce multiple divided sub-frame periods. The drive circuit disclosed in Japanese Patent Laid-Open No. 2013-050681 performs, when phases of bits of tone data corresponding to adjacent pixels are mutually different, a process to maintain their tones and corrects a bit arrangement of the tone data corresponding to one of the adjacent pixels so as to make it closer to a bit arrangement of the tone data corresponding to the other one of the adjacent pixels. This process enables, compared with a case of not dividing the long sub-frame period, shortening the sub-frame period (hereinafter referred to as "an ON/OFF adjacent period") where the ON and OFF periods mutually overlap between the adjacent pixels.

However, in the method disclosed in Japanese Patent Laid-Open No. 2013-050681, a shortest ON/OFF adjacent period of the adjacent pixels is too long to ignore the decrease in lightness due to the disclination. Furthermore, in the method, a long ON/OFF adjacent period of the adjacent pixels increases an amount of the decrease in lightness due to the disclination depending on a response speed of liquid crystal molecules.

FIG. 15 illustrates all tone data disclosed in Japanese Patent Laid-Open No. 2013-050681 where an A sub-frame corresponds to a temporal weight of 1+2+4+8 and a B sub-frame is divided into multiple divided sub-frame periods 1SF (SF means a sub-frame) to 10SF each corresponding to a temporal weight of 8. One divided sub-frame period is 0.39 ms. In the tone data, the shortest ON/OFF adjacent period of the adjacent pixels is 1.39 ms that corresponds to two divided sub-frame period. Thus, the decrease in lightness (that is, the dark line) due to the disclination is noticeable.

SUMMARY OF THE INVENTION

The present invention provides a liquid crystal drive apparatus capable of shortening an ON/OFF adjacent period of adjacent pixels and thereby reducing a decrease in lightness due to disclination. The present invention further provides an image display apparatus using the liquid crystal drive apparatus.

The present invention provides as an aspect thereof a liquid crystal drive apparatus configured to drive a liquid crystal element. The apparatus includes an image acquirer configured to acquire an input image, and a driver configured to control, depending on the input image, application of a first voltage or a second voltage lower than the first voltage to each of multiple pixels of the liquid crystal element in respective multiple sub-frame periods included in one frame period to cause that pixel to form a tone. When the sub-frame period where the first voltage is applied to the pixel is referred to as an ON period, the sub-frame period where the second voltage is applied to the pixel is referred to as an OFF period, and the sub-frame period that corresponds to the ON period and the OFF period respectively for a first pixel and a second pixel of two mutually adjacent pixels in the multiple pixels is referred to as an ON/OFF adjacent period, the driver is configured to provide, when causing the first and second pixels to form tones adjacent to each other, a plurality of the ON/OFF adjacent periods each being 1.0 ms or less separately from each other in the one frame period.

The present invention provides as yet another aspect thereof an image display apparatus including a liquid crystal element, and the above liquid crystal drive apparatus.

The present invention provides as still another aspect thereof a non-transitory computer-readable storage medium storing a liquid crystal drive program as a computer program to cause a computer as the above liquid crystal drive apparatus to drive the liquid crystal element.

Further features and aspects of the present invention will become apparent from the following description of exemplary embodiments with reference to the attached drawings.

DESCRIPTION OF THE EMBODIMENTS

Exemplary embodiments of the present invention will hereinafter be described with reference to the accompanying drawings.

Embodiment 1

Figure 1:
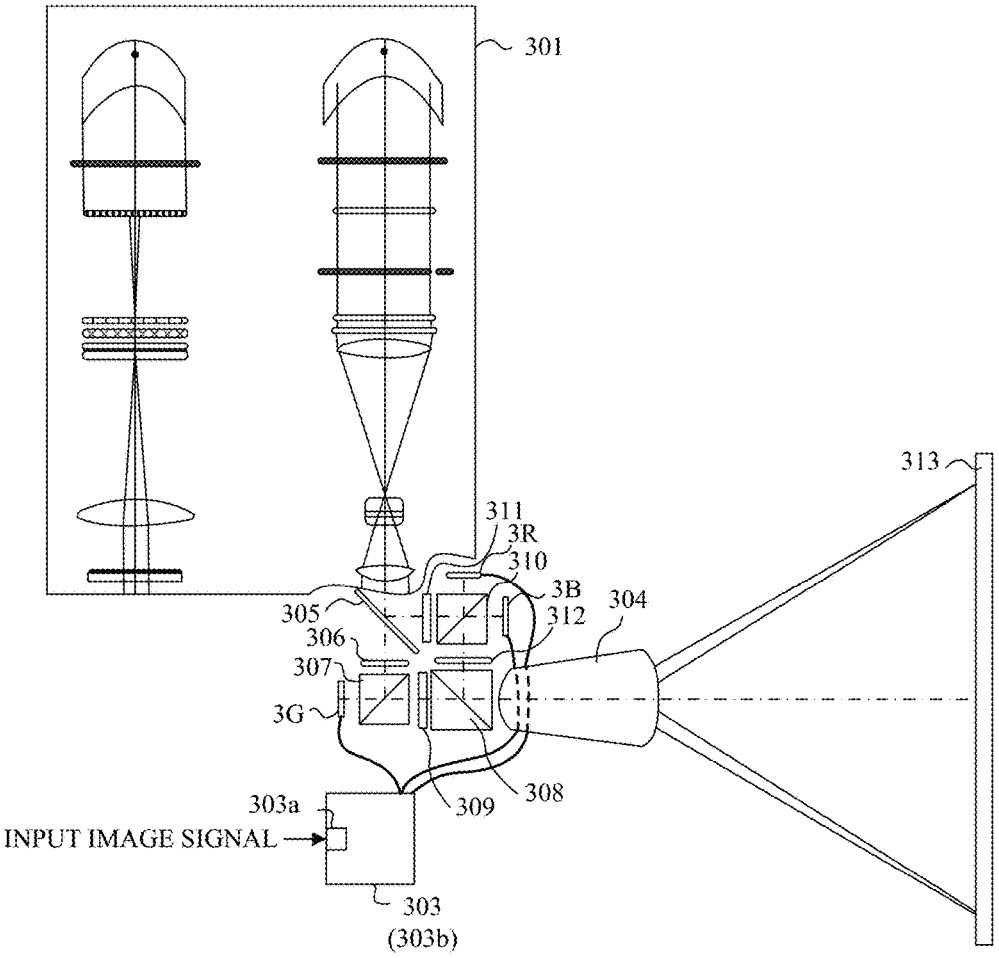
FIG. 1 illustrates an optical configuration of a liquid crystal projector that is Embodiment 1 of the present invention.

FIG. 1 illustrates an optical configuration of a liquid crystal projector as an image display apparatus that is a first embodiment (Embodiment 1) of the present invention. Although the projector is an example of image display apparatuses each using a liquid crystal element, the image display apparatuses each using the liquid crystal element include other image display apparatuses than the projector, such as a direct-view monitor.

A liquid crystal driver 303 corresponds to a liquid crystal drive apparatus. The liquid crystal driver 303 includes a video inputter (image acquirer) 303*a* configured to acquire an input video signal (input image) from an external device (not illustrated) and a drive circuit (driver) 303*b* configured to produce a pixel drive signal corresponding to tone data, which will be described later, depending on tones (input tones) of the input video signal. The pixel drive signal is produced for each of red, green and blue colors; a red pixel drive signal, a green pixel drive signal and a blue pixel drive signal are input respectively to a red liquid crystal element 3R, a green liquid crystal element 3G and a blue liquid crystal element 3B. The red, green and blue pixel drive signals enables individually driving the red liquid crystal element 3R, the green liquid crystal element 3G and the blue liquid crystal element 3B. The red liquid crystal element 3R, the green liquid crystal element 3G and the blue liquid crystal element 3B are each a reflective liquid crystal element of a vertical alignment mode.

An illumination optical system 301 converts a white light from a light source (such as a discharge lamp) into an illumination light having a fixed polarization direction and introduces the illumination light to a dichroic mirror 305. The dichroic mirror 305 reflects a magenta light and transmits a green light. The magenta light reflected by the dichroic mirror 305 enters a blue cross color polarizer 311 that provides a half wavelength retardation only to a blue color to produce the blue light and a red light whose polarization directions are orthogonal to each other. The blue light and the red light enter a polarization beam splitter 310. The blue light is transmitted through a polarization beam splitting film of the polarization beam splitter 310 to be introduced to the blue liquid crystal element 3B. The red light is reflected by the polarization beam splitting film to be introduced to the red liquid crystal element 3R.

On the other hand, the green light transmitted through the dichroic mirror 305 passes through a dummy glass 306 for correcting a green optical path length and then enters a polarization beam splitter 307. The green light is reflected by a polarization beam splitting film of the polarization beam splitter 307 to be introduced to the green liquid crystal element 3G. Each of the liquid crystal elements 3R, 3G and 3B modulates the introduced light depending on modulation states of its pixels and reflects the modulated light. The red light modulated by the red liquid crystal element 3R is transmitted through the polarization beam splitting film of the polarization beam splitter 310 and then enters a red cross color polarizer 312 that provides a half wavelength retardation to the red color. Thereafter, the red light enters a polarization beam splitter 308 and is reflected by a polarization beam splitting film thereof to be introduced to a projection optical system 304.

The blue light modulated by the blue liquid crystal element 3B is reflected by the polarization beam splitting film of the polarization beam splitter 310, is transmitted through the red cross color polarizer 312 without being changed, enters the polarization beam splitter 308 and then is reflected by the polarization beam splitting film thereof to be introduced to the projection optical system 304. The green light modulated by the green liquid crystal element 3G is transmitted through the polarization beam splitting film of the polarization beam splitter 307, passes through a dummy glass 309 for correcting the green optical path length, enters the polarization beam splitter 308 and then is transmitted through the polarization beam splitting film thereof to be introduced to the projection optical system 304. The red light, the green light and the blue light thus color-combined enter the projection optical system 304. The color-combined color light is enlarged and projected by the projection optical system 304 onto a projection surface 313 such as a screen.

Although this embodiment describes the case of using reflective liquid crystal elements, transmissive liquid crystal elements may be used.

Figure 2:
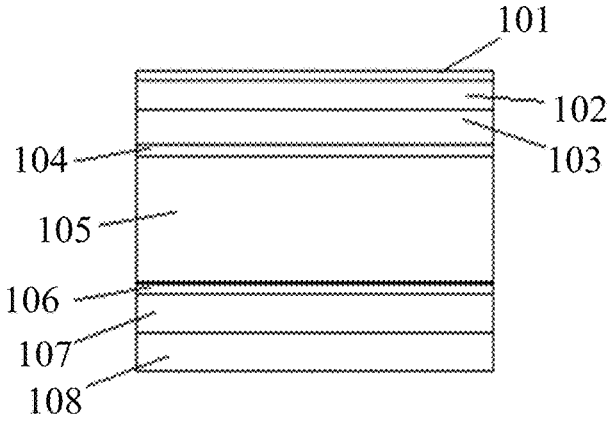
FIG. 2 is a sectional view of a liquid crystal element used in the projector of Embodiment 1.

FIG. 2 illustrates a sectional structure of the reflective liquid crystal element (3R, 3G and 3B). Reference numeral 101 denotes an anti-reflection coating film, 102 a glass substrate, 103 a common electrode, 104 an alignment film, 105 a liquid crystal layer, 106 an another alignment film, 107 a pixel electrode and 108 an Si substrate.

The liquid crystal driver 303 illustrated in FIG. 1 drives the pixels of the liquid crystal element by the above-described sub-frame drive method. That is, the liquid crystal driver 303 temporally divides one frame period into multiple sub-frame periods and controls ON (application) and OFF (non-application) of a predetermined voltage to each of the pixels depending on tone data to cause the pixel to form (display) its tone. The one frame period is a period where one frame image is displayed on the liquid crystal element. This embodiment drives the liquid crystal element at a frequency of 120 Hz and thereby sets the one frame period to 8.33 ms. Alternatively, the liquid crystal element may be driven at a frequency of 60 Hz to set the one frame period to 16.67 ms. The ON and OFF of the predetermined voltage can be reworded as application of a first voltage as the predetermined voltage and application of a second voltage lower than the first voltage.

Description will hereinafter be made of setting of the sub-frame period and the tone data in the liquid crystal driver 303. The liquid crystal driver 303 may be constituted by a computer and control the setting of the sub-frame period and the ON/OFF of the predetermined voltage in each sub-frame period according to a liquid crystal drive program as a computer program.

Figure 3:
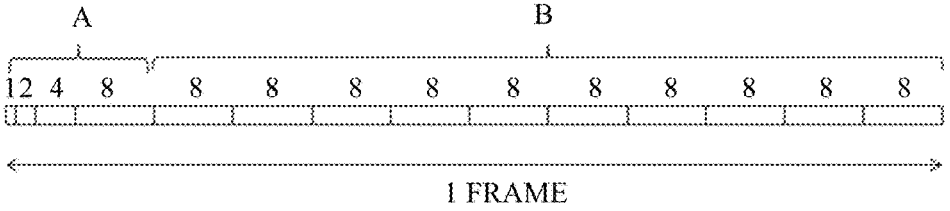
FIG. 3 illustrates multiple sub-frame periods in one frame period in Embodiment 1.

FIG. 3 illustrates the division of the one frame period into the multiple sub-frame periods (bit lengths) in this embodiment. Numerical values written in the respective sub-frames indicate temporal weights of these sub-frames in the one frame period. This embodiment expresses 96 tones. In this description, a period of a temporal weight of 1+2+4+8 is referred to as "an A sub-frame period" (first period), and bits indicating a tone as a binarized value in the A sub-frame period is referred to as "lower bits". Ten sub-frame periods of temporal weights of 8 are collectively referred to as "a B sub-frame period" (second period), and bits indicating a tone as a binarized value in the B sub-frame period is referred to as "higher bits". A temporal weight of 1 corresponds to 0.087 ms, and therefore the temporal weight of 8 corresponds to 0.69 ms. In addition, a sub-frame period where the above-mentioned predetermined voltage is applied (that is, a first voltage is applied) is referred to as an ON period", and a sub-frame period where the predetermined voltage is not applied (that is, a second voltage is applied) is referred to as an OFF period".

Figure 4:
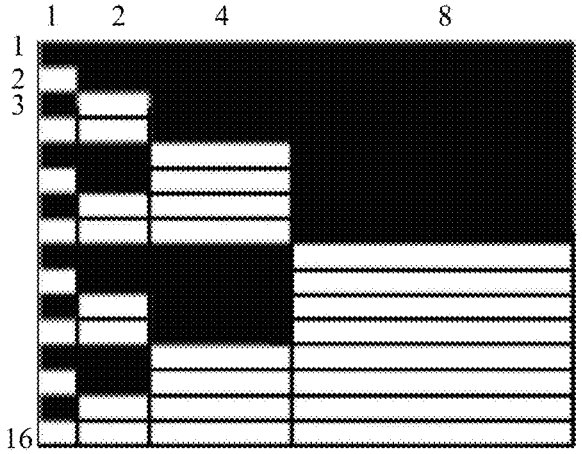
FIG. 4 illustrates tone data in an A sub-frame period in Embodiment 1.

FIG. 4 illustrates tone data in the A sub-frame period illustrated in FIG. 3. A vertical axis indicates tones, and a horizontal axis indicates one frame period. In the A sub-frame period, 16 tones are expressed. A white sub-frame period in FIG. 4 indicates the ON period where the predetermined voltage is applied to a pixel such that the pixel becomes a white display state, and a black sub-frame period indicates the OFF period where the predetermined voltage is not applied to the pixel such that the pixel becomes a black display state.

Figure 5:
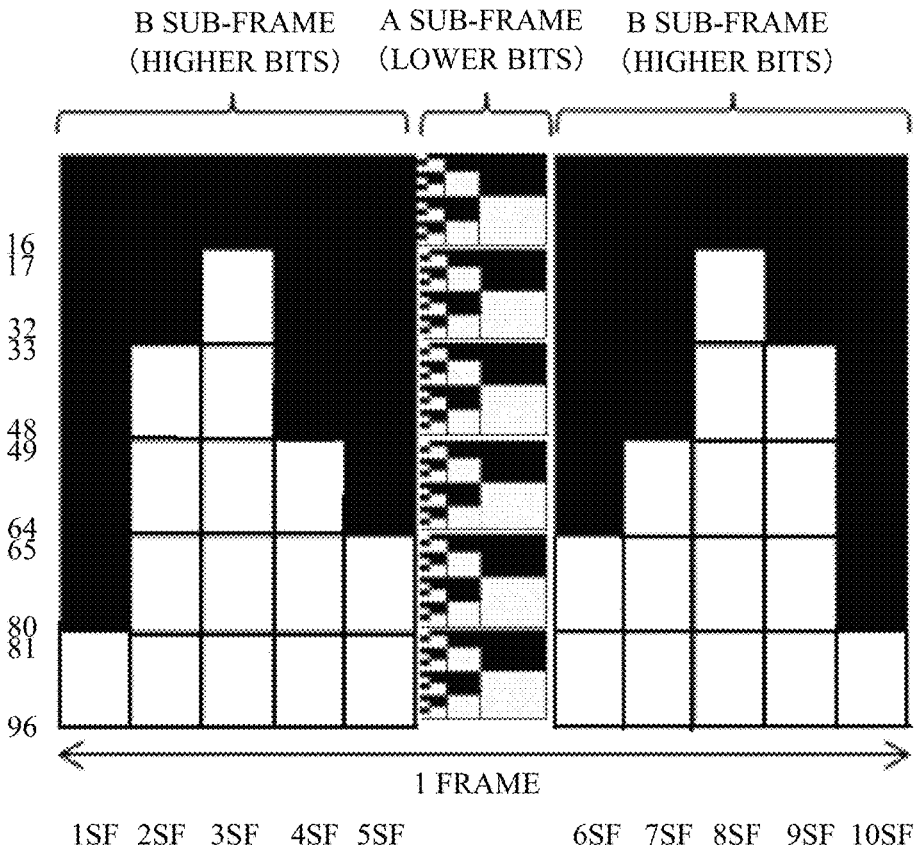
FIG. 5 illustrates all tone data in Embodiment 1.

FIG. 5 illustrates tone data (lower and higher bits) in the A and B sub-frame periods in this embodiment. These tone data are to express the entire 96 tones. In these data, the A sub-frame period (lower bits) is placed at a temporal center of the one frame period, and the B sub-frame periods (higher bits) divided into 1SF to 5SF and 6SF to 10SF are placed before and after the A sub-frame period. That is, the B sub-frame period is divided into two, and each of the divided B sub-frame periods includes two or more sub-frame periods.

According to these tone data, when adjacent pixels that are pixels adjacent to each other in the liquid crystal element display adjacent tones that are two tones adjacent to each other, for example, 48 and tones, the A sub-frame period is set to the ON period for displaying the 48 tone and to the OFF period for displaying the 49 tone.

To display the 48 tone, in the B sub-frame period, 1SF, 4SF, 5SF, 6SF, 7SF and 10SF are set to the OFF period, and 2SF, 3SF, 8SF and 9SF are set to the ON period.

To display the 49 tone, in the B sub-frame period, 1SF, 5SF, 6SF, and 10SF are set to the OFF period, and 2SF, 3SF, 4SF, 7SF, 8SF and 9SF are set to the ON period. When the adjacent pixels display such adjacent tones, an ON/OFF adjacent period where the ON and OFF periods overlap between the adjacent pixels is generated. Specifically, when the adjacent pixels display the 48 and 49 tones, 4SF and 7SF in the B sub-frame period are each the ON/OFF adjacent period.

Figure 15:
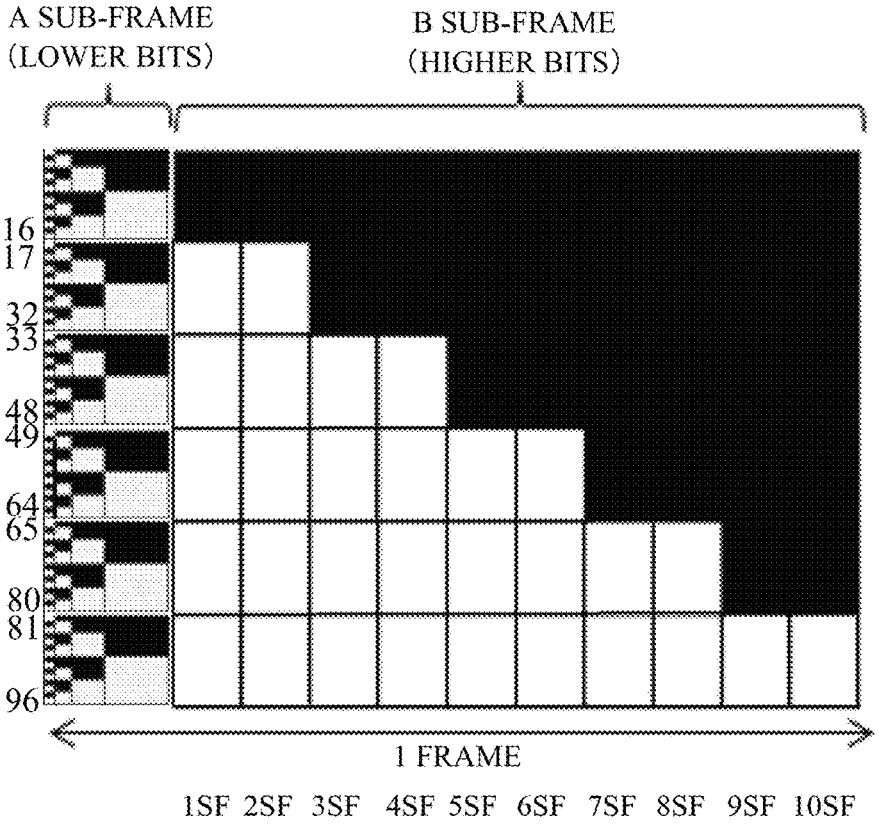
FIG. 15 (PRIOR ART)
FIG. 15 illustrates all tone data disclosed in Japanese Patent Laid-Open No. 2013-050681.

Comparison of the tone data in this embodiment with the conventional tone data illustrated in FIG. 15 (Japanese Patent Laid-Open No. 2013-050681) will here be made. In the tone data illustrated in FIG. 15, the B sub-frame period as a single period continues after the A sub-frame period. However, in the tone data in this embodiment illustrated in FIG. 5, the B sub-frame periods as divided periods are placed before and after the A sub-frame period. In FIG. 15, when, for example, the 48 and 49 tones are displayed, 5SF and 6SF in the B sub-frame period are the ON/OFF adjacent periods. That is, a single ON/OFF adjacent period from 5SF to 6SF continues for a period corresponding to a temporal weight of 16. This also applies to other adjacent tones such as 16 and 17 tones, 32 and 33 tones, 64 and 65 tones and 80 and 81 tones. On the other hand, in this embodiment of FIG. 5, at any of the above-mentioned adjacent tones, a single ON/OFF adjacent period continues in the B sub-frame period only for one sub-frame period whose temporal weight 8 (corresponding to 0.69 ms). A plurality of (two) such ON/OFF adjacent periods each being one sub-frame period are disposed separately from each other across the A sub-frame period.

Figure 6:
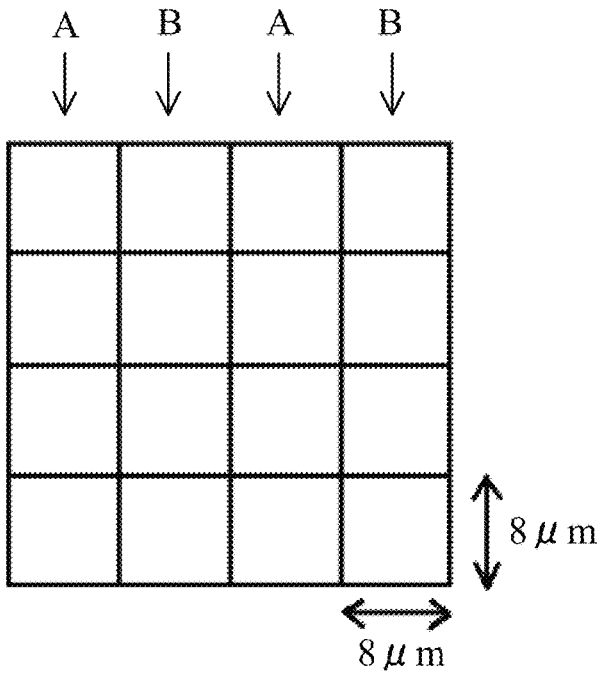
FIG. 6 illustrates pixel lines in Embodiment 1.

Next, description will be made of effects provided by disposing the ON/OFF adjacent periods separately. First, description will be made of a liquid crystal characteristic of the liquid crystal element when its pixels arranged in a matrix form as illustrated in FIG. 6 are switched from an entire white display state to a white and black display state where white and black are alternately displayed one pixel line by one pixel line and another liquid crystal characteristic when the pixels are switched from an entire black display state to the white and black display state. In FIG. 6, 4×4 pixels are arranged in the matrix form with a pixel pitch of 8 μm. In the entire white display state, both pixels included in A pixel lines and B pixel lines display white as illustrated in FIG. 6. In the white and black display state, the pixels of the A pixel lines are switched from the white display state to the black display state, and on the other hand the pixels of the B pixel lines are maintained in the white display state.

Figure 7:
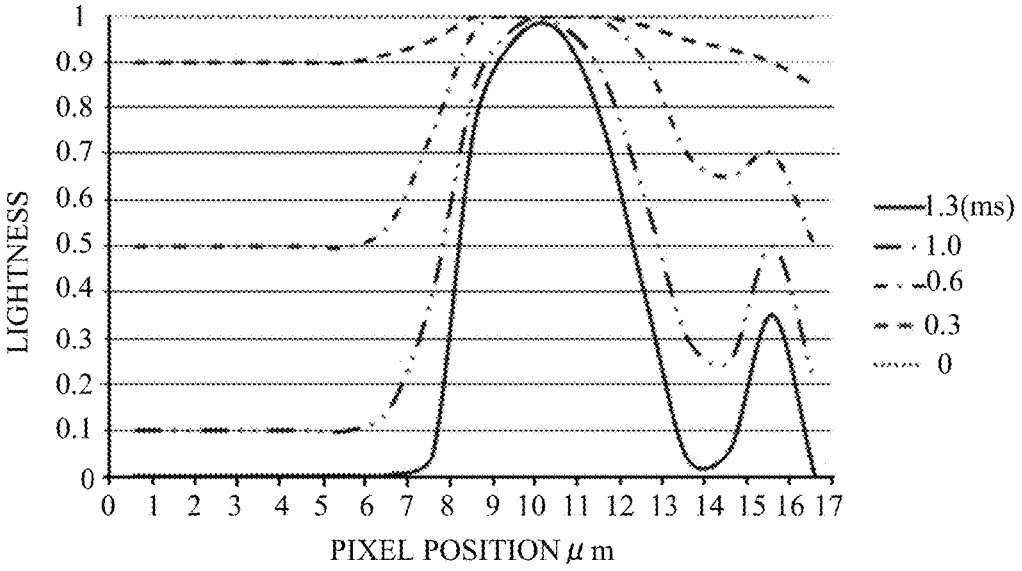
FIG. 7 illustrates a liquid crystal response characteristic when a switching is made from an entire white display state to a white and black display state in Embodiment 1.

FIG. 7 illustrates the liquid crystal characteristics. A horizontal axis indicates pixel positions, and a vertical axis indicates lightness (as a ratio when a lightness of white is 1) of each pixel. A pixel position range from 0 to 8 μm on the horizontal line corresponds to the pixel of the A pixel line illustrated in FIG. 6, and a pixel position range from 8 μm to 16 μm thereon corresponds to the pixel of the B pixel line. Multiple curves indicate lightnesses at elapsed times (0.3 ms, 0.6 ms, 1.0 ms and 1.3 ms) when the display state of the pixels is switched from the entire white display state to the white and black display state at 0 ms.

As described above, when the pixels of each A pixel line are switched from the white display state to the black display state, the lightness of the pixels of each A pixel line are approximately evenly changed (darkened) without being affected by the above-described disclination because of a relation with a direction of a pre-tilt angle of liquid crystal molecules.

On the other hand, in the pixels of each B pixel line, the disclination is not generated in the entire white display state. However, after the switching to the white and black display state, the lightness curve gradually deforms to a distorted shape with time due to the disclination, and especially in a pixel position range around 12 μm to 16 μm, the lightness darkens (a dark line is generated).

In general, a gamma curve (gamma characteristic) for setting drive tones of the liquid crystal element with respect to input tones is produced depending on a response characteristic of the liquid crystal element obtained by changing a displayed tone while causing the liquid crystal element to display an identical display tone on its whole surface with no disclination. Therefore, driving the liquid crystal element using such a gamma curve generates the disclination in the white and black display state, which only provides a lower lightness than the original lightness corresponding to the gamma curve.

Figure 8:
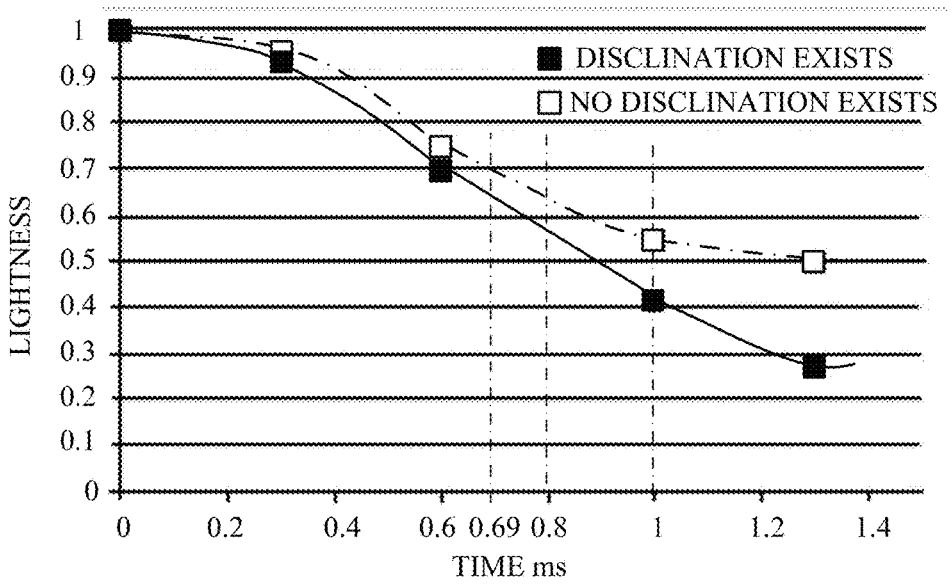
FIG. 8 illustrates a lightness response characteristic when the switching is made from the entire white display state to the white and black display state in Embodiment 1.

FIG. 8 illustrates changes of the lightness when the switching of the liquid crystal element from the entire white display state to the white and black display state generates the disclination and when the switching does not generate the disclination. A horizontal axis indicates elapsed times from the switching of the display state, and a vertical line indicates the lightness as an integrated value of a total lightness of the A and B pixel lines. The lightness is indicated by a ratio when a lightness in the entire white display state is 1. When the disclination is generated (that is, "disclination exists"), the lightness of the pixels of the A pixel line changes with a characteristic close to the liquid crystal response characteristic illustrated in a pixel position range around 1 μm to 6 μm in FIG. 7, and the lightness of the pixels of the B pixel line corresponds to white with 100% lightness. Then, as time proceeds, an amount of a decrease in lightness when the disclination exists increases further than that when the disclination is not generated (that is, "no disclination exists").

Figure 9:
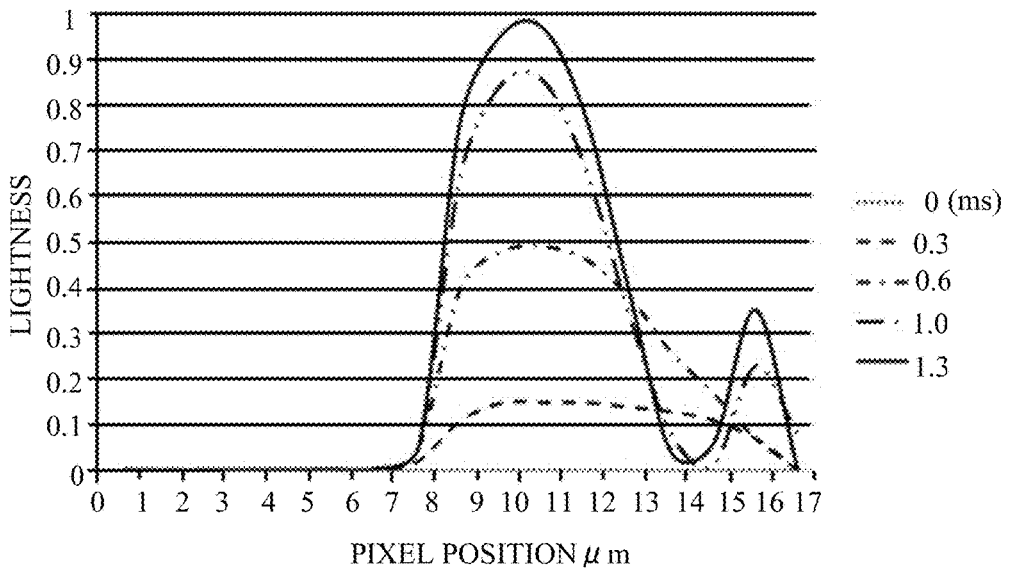
FIG. 9 illustrates a liquid crystal response characteristic when a switching is made from an entire black display state to the white and black display state in Embodiment 1.

On the other hand, when the liquid crystal element is switched from the entire black display state to the white and black display state, from a state where the pixels of both the A and B pixel lines are in the black display state, the pixels of the B pixel lines illustrated in FIG. 6 are switched to the white display state while the pixels of the A pixel lines are maintained in the black display state. FIG. 9 illustrates the liquid crystal response characteristic when this switching is made. A horizontal axis indicates pixel positions, and a vertical axis indicates lightness (as a ratio when the lightness of white is 1). A pixel position range from 0 to 8 μm on the horizontal line corresponds to the pixel of the A pixel line illustrated in FIG. 6, and a pixel position range from 8 μm to 16 μm thereon corresponds to the pixel of the B pixel line. Multiple curves indicate lightnesses at elapsed times (0.3 ms, 0.6 ms, 1.0 ms and 1.3 ms) when the display state of the pixels is switched from the entire black display state to the white and black display state at 0 ms.

In the pixels of the B pixel line switched from the black display state to the white display state, after the switching to the white display state, the lightness curve gradually deforms to a distorted shape with time due to the disclination, and especially in a pixel position range around 12 μm to 16 μm, the lightness darkens (a dark line is generated). Furthermore, the distorted shape of the lightness curve becomes significant with time.

As described above, the gamma curve (gamma characteristic) for setting the drive tones of the liquid crystal element with respect to the input tones is produced depending on the liquid crystal response characteristic obtained by changing the displayed tone while causing the liquid crystal element to display an identical display tone on its whole surface with no disclination. Therefore, driving the liquid crystal element using such a gamma curve generates the disclination in the white and black display state, which only provides a lower lightness than the original lightness corresponding to the gamma curve.

Figure 10:
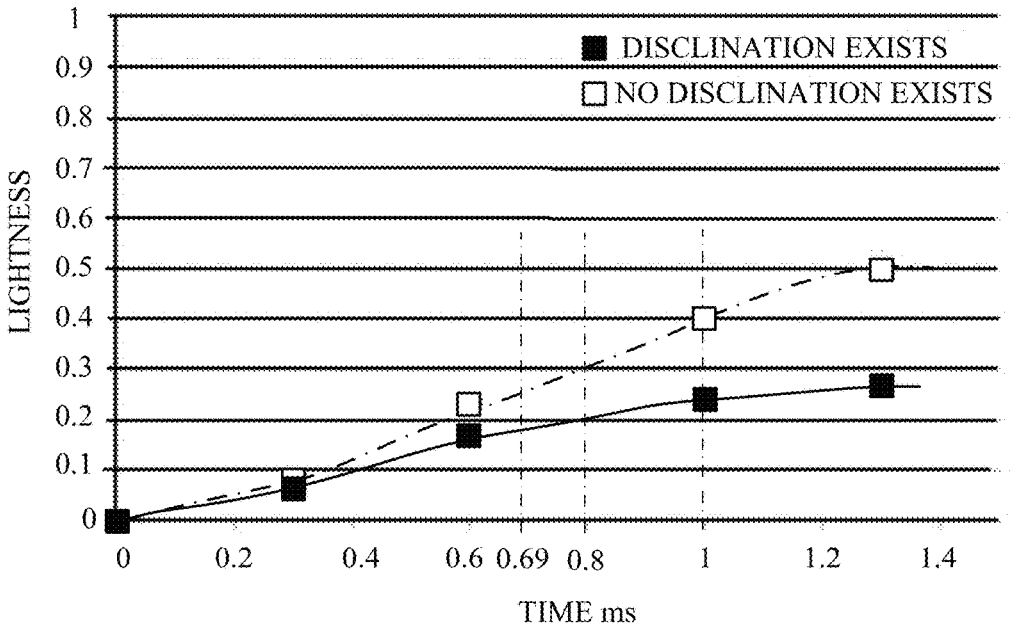
FIG. 10 illustrates a lightness response characteristic when the switching is made from the entire black display state to the white and black display state in Embodiment 1.

FIG. 10 illustrates changes of the lightness when the switching of the liquid crystal element from the entire black display state to the white and black display state generates the disclination and when the switching does not generate the disclination. A horizontal axis indicates elapsed times from the switching of the display state, and a vertical line indicates the lightness as an integrated value of a total lightness of the A and B pixel lines. The lightness is indicated by a ratio when the lightness in the entire white display state is 1. As the lightness that changes when the disclination is not generated ("no disclination exits"), a lightness when the pixels of the B lines are changed from the black display state to the white display state while the pixels of the A pixel line are maintained in the black display state is illustrated. On the other hand, as the lightness that changes when the disclination is generated ("disclination exits"), the integrated value of a sum of lightnesses of the pixels of the A and B pixel lines illustrated in FIG. 9 is illustrated.

In FIG. 10, when the disclination is generated, an amount of an increase in lightness is smaller than that when the disclination is not generated. That is, a longer time period where the disclination is generated after the display state is switched from the entire black display state to the white and black display state makes the lightness darker than that when the disclination is not generated.

Next, description will be made of a case of causing the pixels of the A pixel line to display the 48 tone and causing the pixels of the B pixel line to display the 49 tone according to the conventional tone data illustrated in FIG. 15. When these tone data are used, the disclination is generated in 5SF and 6SF in the B sub-frame period where a disclination generation state is established in which the pixels of the A pixel line are in the black display state and the pixels of the B pixel line are in the white display state. On the other hand, 4SF before 5SF, where the pixels of both the A and B pixel lines are in the white display state, is a period where the disclination is not generated.

A liquid crystal response characteristic in 5SF and 6SF corresponds to that when the "disclination exists" in FIG. 8.

The lightness in 4SF where the display state is the entire white display state is at 100% output and then the disclination is generated during 1.39 ms from a start of 5SF to an end of 6SF, so that the start of 5SF corresponds to 0 ms in FIG. 8, and the end of 6SF corresponds to 1.39 ms. During the 1.39 ms, the lightness decreases to 0.27 with respect to 0.5 when "no disclination exists". When the gamma characteristic produced on condition that the liquid crystal element displays the identical display tone on its whole surface as described above is used as a base, the generation of the disclination from 5SF to 6SF darkens the lightness to 54% (=0.27/0.5) in ratio.

Next, in this embodiment, a case of causing the pixels (second pixels) of the A pixel line to display the 48 tone and causing the pixels (first pixels) of the B pixel line to display the 49 tone according to the tone data illustrated in FIG. 5 will be described. When these tone data are used, the disclination is generated in 4SF and 7SF in the B sub-frame period where the pixels of the A and B pixel lines are in the above-mentioned disclination generation state. On the other hand, 3SF before 4SF, where the pixels of both the A and B pixel lines are in the white display state, is a period where the disclination is not generated.

A liquid crystal response characteristic in 4SF corresponds to that when the "disclination exists" in FIG. 8. The lightness in 3SF where the display state is the entire white display state is at 100% output and the disclination is generated during 0.69 ms in 4SF, so that a start of 4SF corresponds to 0 ms in FIG. 8, and an end of 4SF corresponds to 0.69 ms. During the 0.69 ms, the lightness only decreases to 0.65 with respect to 0.7 when "no disclination exists".

A liquid crystal response characteristic in 7SF that is the other sub-frame period where the disclination is generated corresponds to that when the "disclination exists" in FIG. 10. The lightness in 6SF where the display state is the entire white display state is at 0% and then the disclination is generated during 0.69 ms in 7SF, so that a start of 7SF corresponds to 0 ms in FIG. 10, and an end of 7SF corresponds to 0.69 ms. During the 0.69 ms, the lightness only decreases to 0.18 with respect to 0.25 when "no disclination exists".

A sum of the lightnesses in 4SF and 7SF when the disclination is not generated is 0.95 (=0.70+0.25), and on the other hand, a sum of the lightnesses in 4SF and 7SF when the disclination is generated is 0.83 (=0.65+0.18). When the gamma characteristic produced on condition that the liquid crystal element displays the identical display tone on its whole surface is used as the base, the generation of the disclination in this case only darkens the lightness to 87% (=0.83/0.95) in ratio. That is, this embodiment enables reducing the decrease in lightness. Next, description will be made of a case where other adjacent tones are displayed. First, description will be made of a case of causing the pixels of the A pixel line illustrated in FIG. 6 to display 16 tone and causing the pixels of the B pixel line to display 17 tone according to the conventional tone data illustrated in FIG. 15. When these tone data are used, the disclination is generated in 1SF and 2SF in the B sub-frame period where a disclination generation state is established in which the pixels of the A pixel line are in the black display state and the pixels of the B pixel line are in the white display state.

The liquid crystal response characteristic in 1SF to 2SF corresponds to that when the "disclination exists" in FIG. 10. The disclination is generated during 1.39 ms from a start of 1SF to an end of 2SF, so that the start of 1SF corresponds to 0 ms in FIG. 10, and the end of 2SF corresponds to 1.39 ms. During the 1.39 ms, the lightness decreases to 0.27 with respect to 0.5 when "no disclination exists". When the gamma characteristic produced on condition that the liquid crystal element displays the identical display tone on its whole surface as described above is used as the base, the generation of the disclination from 1SF to 2SF darkens the lightness to 54% (=0.27/0.5) in ratio.

Next, in this embodiment, a case of causing the pixels (second pixels) of the A pixel line to display the 16 tone and causing the pixels (first pixels) of the B pixel line to display the 17 tone according to the tone data illustrated in FIG. 5 will be described. When these tone data are used, the disclination is generated in 3SF and 8SF in the B sub-frame period where the pixels of the A and B pixel lines are in the above-mentioned disclination generation state. On the other hand, 2SF before 3SF, where the pixels of both the A and B pixel lines are in the black display state, is a period where the disclination is not generated. A liquid crystal response characteristic in 3SF corresponds to that when the "disclination exists" in FIG. 10. The lightness in 2SF where the display state is the entire black display state is at 0% and then the disclination is generated during 0.69 ms in 3SF, so that a start of 7SF corresponds to 0 ms in FIG. 10, and an end of 3SF corresponds to 0.69 ms. During the 0.69 ms, the lightness only decreases to 0.18 with respect to 0.25 when "no disclination exists".

A liquid crystal response characteristic in 8SF that is the other sub-frame period where the disclination is generated also corresponds to that when the "disclination exists" in FIG. 10. The lightness in 7SF where the display state is the entire black display state is at 0% and then the disclination is generated during 0.69 ms in 8SF, so that a start of 8SF corresponds to 0 ms in FIG. 10, and an end of 8SF corresponds to 0.69 ms. During the 0.69 ms, the lightness only decreases to 0.18 with respect to 0.25 when "no disclination exists".

A sum of the lightnesses in 3SF and 8SF when the disclination is not generated is 0.50 (=0.25+0.25), and on the other hand, a sum of the lightnesses in 3SF and 8SF when the disclination is generated is 0.36 (=0.18+0.18). When the gamma characteristic produced on condition that the liquid crystal element displays the identical display tone on its whole surface is used as the base, the generation of the disclination in this case only darkens the lightness to 72% (=0.36/0.50) in ratio. That is, this embodiment enables reducing the decrease in lightness.

As described above, this embodiment provides the plurality of ON/OFF adjacent periods, where the display of the adjacent tones at the adjacent pixels causes the disclination generation state, separately from each other (dispersedly) in the one frame period, which shortens one contiguous ON/OFF adjacent period to 1.0 ms or less. Namely, this embodiment causes, before the amount of the decrease in lightness due to the disclination increases, the disclination generation state to change to the other display state. This embodiment thereby enables reducing the decrease in lightness due to the disclination, which enables displaying a good quality image.

Description will be made of significance of 1.0 ms. In FIG. 8, a lightness at 1.0 ms when the disclination is generated is 0.41. That is, the lightness only decreases to 75% of 0.55 when the disclination is not generated. Furthermore, in FIG. 10, a lightness at 1.0 ms when the disclination is generated is 0.24. That is, the lightness only decreases to 60% of 0.40 when the disclination is not generated.

As described above, setting one contiguous ON/OFF adjacent period to 1.0 ms or less enables reducing a decreasing rate of the lightness to the above-mentioned rates.

It is more desirable that the one contiguous ON/OFF adjacent period be 0.8 ms or less. In FIG. 8, a lightness at 0.8 ms when the disclination is generated is 0.58. That is, the lightness is prevented from decreasing lower than 89% of 0.65 when the disclination is not generated. Furthermore, in FIG. 10, a lightness at 0.8 ms when the disclination is generated is 0.19. That is, the lightness is prevented from decreasing lower than 63% of 0.30 when the disclination is not generated.

Moreover, in this embodiment, it is desirable to provide the plurality of ON/OFF adjacent periods separately from each other only when the one contiguous ON/OFF adjacent period is 0.3 ms or more. In FIG. 8, a lightness at 0.3 ms when the disclination is generated is 0.93. This lightness has a difference of only 2% from 0.95 when the disclination is not generated. In addition, in FIG. 10, a lightness at 0.3 ms when the disclination is generated is 0.08. That is, the lightness decreases only by 10% of 0.09 when the disclination is not generated. A smaller difference in lightness than the above differences at 0.3 ms is almost not visually recognized by human, and therefore it is unnecessary to provide the plurality of ON/OFF adjacent periods separately from each other when the one contiguous ON/OFF adjacent period is shorter than 0.3 ms.

Embodiment 2

Next, description will be made of a second embodiment of the present invention.

Figure 11:
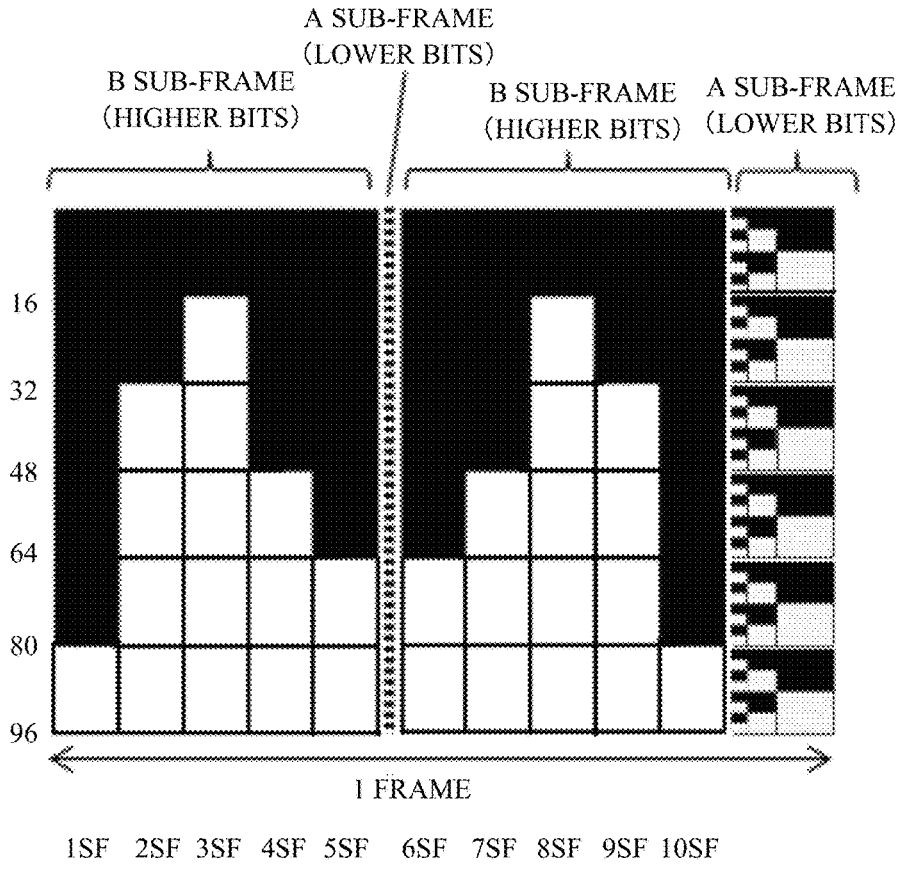
FIG. 11 illustrates all tone data in a comparative example for Embodiment 2 of the present invention.
Figure 12:
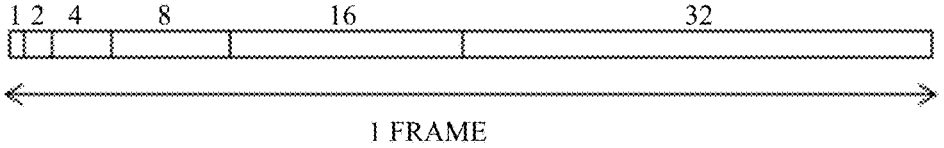
FIG. 12 illustrates conventional multiple sub-frame periods in one frame period.
Figure 13:
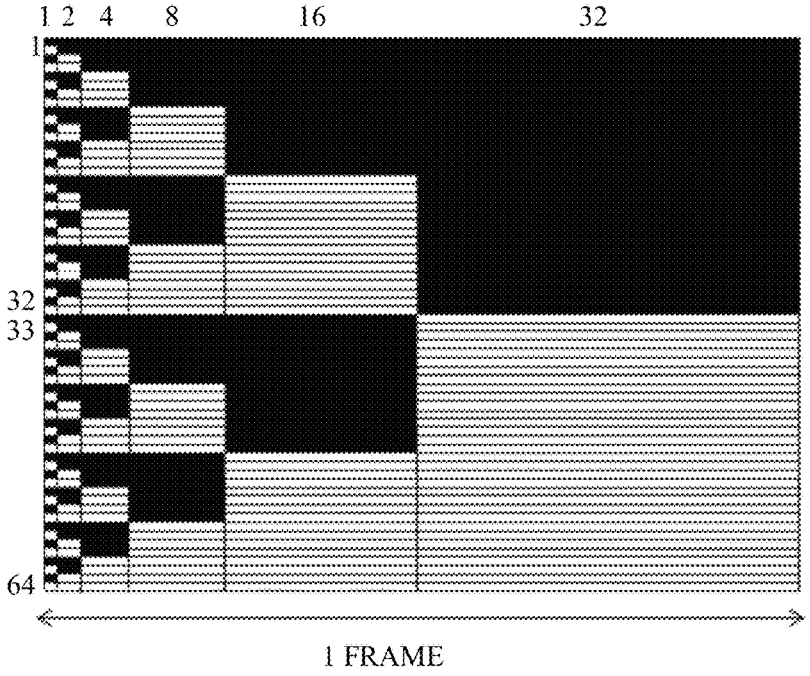
FIG. 13 illustrates conventional all tone data.
Figure 14:
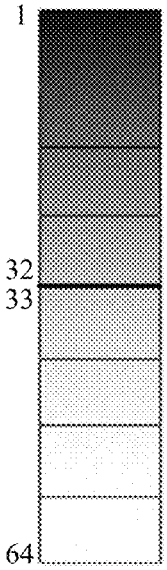
FIG. 14 illustrates disclination generated when a liquid crystal element is driven according to the tone data illustrated in FIG. 13.

FIG. 11 illustrates tone data as a comparative example. The tone data are for expressing entire 96 tones. In the tone data, a B sub-frame period (higher bits) is divided into 1SF to 5SF and 6SF to 10SF, and therebetween a sub-frame period of a minimum temporal weight (=1), which is a part of an A-sub frame period (lower bits), is provided. Another part of the A-sub frame period, whose temporal weight is 2+4+8, is provided after 10SF.

Description will be made of a case of causing the pixels of the A pixel line illustrated in FIG. 6 to display 64 tone and causing the pixels of the B pixel line to display 65 tone according to the tone data illustrated in FIG. 11. When these tone data are used, the disclination is generated in 5SF and 6SF in the B sub-frame period where the disclination generation state is established in which the pixels of the A pixel line are in the black display state and the pixels of the B pixel line are in the white display state.

A liquid crystal response characteristic in 5SF and 6SF corresponds to that when the "disclination exists" in FIG. 8. Since the disclination is generated during 0.69 ms in 5SF, so that a start of 5SF corresponds to 0 ms in FIG. 8, and an end of 5SF corresponds to 0.69 ms. During the 0.69 ms, the lightness decreases to 0.65 with respect to 0.7 when "no disclination exists".

Although the sub-frame period whose temporal weight is 1 is provided after 5SF, this temporal weight is small, so that a transition to next 6SF is made with almost no influence on the liquid crystal response characteristic. That is, the liquid crystal response characteristic is equivalent to that when 5SF and 6SF are continuously provided. Therefore, the disclination is continuously generated until 1.39 ms corresponding to an end of 6SF. During the 1.39 ms, the lightness decreases to 0.27 with respect to 0.5 when "no disclination exists". When the gamma characteristic produced on condition that the liquid crystal element displays the identical display tone on its whole surface is used as the base, the generation of the disclination from 5SF to 6SF darkens the lightness to 54% (=0.27/0.5) in ratio.

Next, in this embodiment, a case of causing the pixels (second pixels) of the A pixel line to display the 64 tone and causing the pixels (first pixels) of the B pixel line to display the 65 tone according to the tone data illustrated in FIG. 5 will be described. When these tone data are used, the disclination is generated in 5SF and 6SF in the B sub-frame period where the pixels of the A and B pixel lines are in the above-described disclination generation state. On the other hand, 4SF before 5SF, where the pixels of both the A and B pixel lines are in the white display state, is a period where the disclination is not generated. A liquid crystal response characteristic in 5SF corresponds to that when the "disclination exists" in FIG. 8. The lightness in 4SF where the display state is the entire white display state is at 100% and then the disclination is generated during 0.69 ms from a start of 5SF to an end of 5SF, so that the start of 5SF corresponds to 0 ms in FIG. 8, and the end of 5SF corresponds to 0.69 ms. During the 0.69 ms, the lightness only decreases to 0.65 with respect to 0.7 when "no disclination exists".

A liquid crystal response characteristic in 6SF that is provided across the A sub-frame period whose temporal weight is 1+2+4+8 from 5SF and is the other sub-frame period where the disclination is generated corresponds to that when the "disclination exists" in FIG. 10. In the A sub-frame period immediately before 6SF, the pixels of the A pixel line are in the white display state and the pixels of the B pixel line are in the black display state. Since the disclination is generated when the pixels of the A pixel line are in the black display state and the pixels of the B pixel line are in the white display state because of the relation with the direction of the pre-tilt angle of the liquid crystal molecules, the disclination is not generated in the A sub-frame period. Accordingly, a start of 6SF corresponds to 0 ms in FIG. 10 (the lightness decreases from 0.5 in the A sub-frame period), and an end of 6SF corresponds to 0.69 ms. During the 0.69 ms, the lightness only decreases to 0.18 with respect to 0.25 when "no disclination exists".

A sum of the lightnesses in 5SF and 6SF when the disclination is not generated is 0.95 (=0.70+0.25), and on the other hand, a sum of the lightnesses in 5SF and 6SF when the disclination is generated is 0.83 (=0.65+0.18). When the gamma characteristic produced on condition that the liquid crystal element displays the identical display tone on its whole surface is used as the base, the generation of the disclination in this case only darkens the lightness to 87% (=0.83/0.95) in ratio. That is, this embodiment enables reducing the decrease in lightness.

As described above, when the disclination is continuously generated for a period of 0.3 ms or more (and 1.0 ms or less), it is desirable to divide the period and provide between the divided periods a period of 0.6 ms or more where the disclination is not generated. That is, it is desirable to provide a plurality of multiple ON/OFF adjacent periods such that each contiguous ON/OFF adjacent period is 0.3 ms or more and provide therebetween a sub-frame period that is not the ON/OFF adjacent period and is 0.6 ms or more. The sub-frame period that is not the ON/OFF adjacent period includes a sub-frame period where the adjacent pixels are both in the ON period, a sub-frame period where the adjacent pixels are both in the OFF period, and a sub-frame period (A sub-frame period) where one pixel of the adjacent pixels whose tone is lower than that of the other pixel is in the ON period and the other pixel whose tone is higher is in the OFF period. This embodiment thereby enables reducing the decrease in lightness due to the disclination, which enables displaying a good quality image.

Each of the above-described embodiments provides to the adjacent pixels the ON/OFF adjacent period shorter than a period where the decrease in lightness becomes noticeable, thereby enabling reducing the decrease in lightness due to the disclination and thus displaying a good quality image.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176811, filed on Sep. 8, 2015, which is hereby incorporated by reference herein in its entirety.

What is claimed is:

1. A liquid crystal drive apparatus configured to drive a liquid crystal element, the apparatus comprising:

a memory configured to store instructions; and a processor configured to execute the instructions to function as:

an image acquirer configured to acquire an input image; and a driver configured to control, depending on the input image, application of a first voltage or a second voltage lower than the first voltage to each of multiple pixels of the liquid crystal element in respective multiple sub-frame periods included in one frame period to cause that pixel to form a tone, wherein, when the sub-frame period where the first voltage is applied to the pixel is referred to as an ON period, the sub-frame period where the second voltage is applied to the pixel is referred to as an OFF period, and the sub-frame period that corresponds to the ON period and the OFF period respectively for a first pixel and a second pixel of two mutually adjacent pixels in the multiple pixels is referred to as an ON/OFF adjacent period, the driver is configured to provide, when causing the first and second pixels to form tones adjacent to each other, a plurality of the ON/OFF adjacent periods each being 0.8 ms or less separately from each other in the one frame period.

2. A liquid crystal drive apparatus according to claim 1, wherein the first pixel forms a higher tone than that formed by the second pixel.

3. A liquid crystal drive apparatus according to claim 1, wherein each of the ON/OFF adjacent periods is within a range of 0.3 ms to 0.8 ms.

4. A liquid crystal drive apparatus according to claim 1, wherein the driver is configured to provide, when causing the first and second pixels to form the tones adjacent to each other, the sub-frame period not being the ON/OFF adjacent period and being 0.6 ms or more between the ON/OFF adjacent periods, each being within a range of 0.3 ms to 0.8 ms.

5. A liquid crystal drive apparatus according to claim 1, wherein:

the one frame period includes:

a first period including two or more sub-frame periods whose temporal weights are mutually different; and a second period including two or more sub-frame periods whose temporal weights are mutually equal, and the driver is configured to provide the plurality of the ON/OFF adjacent periods in the second period.

6. An image display apparatus comprising:

a liquid crystal element; and a liquid crystal drive apparatus configured to drive the liquid crystal element, wherein liquid crystal drive apparatus comprises:

a memory configured to store instructions; and a processor configured to execute the instructions to function as:

an image acquirer configured to acquire an input image; and a driver configured to control, depending on the input image, application of a first voltage or a second voltage lower than the first voltage to each of multiple pixels of the liquid crystal element in respective multiple sub-frame periods included in one frame period to cause that pixel to form a tone, wherein, when the sub-frame period where the first voltage is applied to the pixel is referred to as an ON period, the sub-frame period where the second voltage is applied to the pixel is referred to as an OFF period, and the sub-frame period that corresponds to the ON period and the OFF period respectively for a first pixel and a second pixel of two mutually adjacent pixels in the multiple pixels is referred to as an ON/OFF adjacent period, the driver is configured to provide, when causing the first and second pixels to form tones adjacent to each other, a plurality of the ON/OFF adjacent periods each being 0.8 ms or less separately from each other in the one frame period.

7. A non-transitory computer-readable storage medium storing a liquid crystal drive program as a computer program to cause a computer to drive a liquid crystal element, the program causing the computer to:

acquire an input image; and control, depending on the input image, application of a first voltage or a second voltage lower than the first voltage to each of multiple pixels of the liquid crystal element in respective multiple sub-frame periods included in one frame period to cause that pixel to form a tone, wherein, when the sub-frame period where the first voltage is applied to the pixel is referred to as an ON period, the sub-frame period where the second voltage is applied to the pixel is referred to as an OFF period, and the sub-frame period that corresponds to the ON period and the OFF period respectively for a first pixel and a second pixel of two mutually adjacent pixels in the multiple pixels is referred to as an ON/OFF adjacent period, the program causes the computer to provide, when causing the first and second pixels to form tones adjacent to each other, a plurality of the ON/OFF adjacent periods each being 0.8 ms or less separately from each other in the one frame period.

* * * * *